US010801279B2

(12) United States Patent
Slettedal

(10) Patent No.: US 10,801,279 B2
(45) Date of Patent: Oct. 13, 2020

(54) FINGERBOARD STORAGE ARRANGEMENT

(71) Applicant: MHWIRTH AS, Kristiansand S (NO)

(72) Inventor: Per Slettedal, Oevreboe (NO)

(73) Assignee: MHWIRTH AS, Kristiansand S (NO)

( * ) Notice: Subject to any disclaimer, the term of this patent is extended or adjusted under 35 U.S.C. 154(b) by 0 days.

(21) Appl. No.: 16/318,708

(22) PCT Filed: Jul. 7, 2017

(86) PCT No.: PCT/NO2017/050184
§ 371 (c)(1),
(2) Date: Jan. 18, 2019

(87) PCT Pub. No.: WO2018/016965
PCT Pub. Date: Jan. 25, 2018

(65) Prior Publication Data

US 2019/0153791 A1 May 23, 2019

(30) Foreign Application Priority Data

Jul. 21, 2016 (NO) ..... 20161208

(51) Int. Cl.
*E21B 19/14* (2006.01)

(52) U.S. Cl.
CPC ..... *E21B 19/143* (2013.01); *E21B 19/14* (2013.01)

(58) Field of Classification Search
CPC ..... E21B 19/143; E21B 19/14
See application file for complete search history.

(56) References Cited

U.S. PATENT DOCUMENTS

| | | | | |
|---|---|---|---|---|
| 2,161,719 | A * | 6/1939 | Minyard | E21B 19/14 211/70.4 |
| 4,773,669 | A * | 9/1988 | Peyre | A63C 9/0842 280/632 |
| 6,427,997 | B1 * | 8/2002 | Hirota | B42C 1/12 270/58.12 |
| 6,674,037 | B2 * | 1/2004 | Ruigrok | A01G 5/00 198/370.03 |
| 8,947,875 | B2 * | 2/2015 | Ogatsu | H04M 1/0237 361/679.55 |
| 9,016,382 | B2 * | 4/2015 | Braxton | E21B 19/14 166/250.01 |
| 9,375,550 | B2 * | 6/2016 | Tegg | A61M 25/0136 |
| 2005/0092524 | A1 | 5/2005 | Herst | |
| 2011/0005162 | A1 | 1/2011 | Roodenburg et al. | |

(Continued)

FOREIGN PATENT DOCUMENTS

| | | |
|---|---|---|
| CN | 204186313 U | 3/2015 |
| WO | WO 01/79651 A1 | 10/2001 |

(Continued)

*Primary Examiner* — Ko H Chan
(74) *Attorney, Agent, or Firm* — Norman B. Thot

(57) ABSTRACT

A fingerboard latch arrangement includes an elongate support member, a latch which moves from a closed position into an open position and from the open position into the closed position, and an activation member which is connected to and which is movable longitudinally along the elongate support member. The activation member includes means to bring the latch from the closed position into the open position and from the open position into the closed position.

20 Claims, 12 Drawing Sheets

(56) References Cited

U.S. PATENT DOCUMENTS

| | | | | |
|---|---|---|---|---|
| 2012/0063072 | A1* | 3/2012 | Murakoso | E05D 11/084 361/679.01 |
| 2015/0048038 | A1 | 2/2015 | Roodenburg et al. | |
| 2015/0209954 | A1* | 7/2015 | Hokanson | B25H 3/003 52/741.14 |
| 2016/0076920 | A1 | 3/2016 | Newton et al. | |
| 2016/0168929 | A1 | 6/2016 | Magnuson et al. | |
| 2016/0320497 | A1 | 11/2016 | Hu et al. | |
| 2018/0002994 | A1* | 1/2018 | Albanese | E21B 19/14 |

FOREIGN PATENT DOCUMENTS

| | | | |
|---|---|---|---|
| WO | WO 2009/082197 | A2 | 7/2009 |
| WO | WO 2013/141697 | A2 | 9/2013 |
| WO | WO 2016/076920 | A2 | 5/2016 |

* cited by examiner

FINGERBOARD STORAGE ARRANGEMENT

CROSS REFERENCE TO PRIOR APPLICATIONS

This application is a U.S. National Phase application under 35 U.S.C. § 371 of International Application No. PCT/NO2017/050184, filed on Jul. 7, 2017 and which claims benefit to Norwegian Patent Application No. 20161208, filed on Jul. 21, 2016. The International Application was published in English on Jan. 25, 2018 as WO 2018/016965 A1 under PCT Article 21(2).

FIELD

The present invention relates to storage arrangement for subsea or well operations, and more particularly to an arrangement for storing tubulars, tools, equipment or other items used in drilling, well intervention, subsea mining, or any similar operation.

BACKGROUND

Various types of storage devices are used in subsea or well operations, such as petroleum drilling, to store tools and equipment, such that these are readily available when needed. In such operations, a string is commonly assembled topside by a plurality of segments which are successively connected to the string and lowered down towards a sea floor or down through a wellbore.

Tubular storage devices, such as fingerboards, on mechanized or automated handling systems are typically arranged as an array of horizontally extending fingerboards arranged in relation to a fixed permanent setback base. Latches or locking fingers are used to hold each tubular in place within the fingerboard. When a tubular section, for example, a section of drill pipe, is to be removed from the fingerboard, the associated latches are opened to allow a pipe handling machine to remove the tubular from the fingerboard. Similarly, when a tubular is placed in the fingerboard for storage, the latches associated with that storage slot is brought to a locking position in order to secure the tubular in the fingerboard.

US 2016/0168929 A1, CN 204186313U, WO 01/79651 A1, WO 2009/082197 A2, WO 2013/141697 A2, WO 2016/076920 A2 and US 2016/0076920 A1 describe examples of known fingerboard assembly configurations.

It is importance that the fingerboard functions properly during operations. When a tubular is placed in the fingerboard, for example, the latches must close securely in order to avoid the tubular from falling out of the fingerboard. Similarly, when a pipe handling machine is operated to remove a tubular from the fingerboard, the latches must open reliably to release the tubular from the storage position. Failure of the fingerboard to function properly may lead to serious accidents, for example, during drilling operations with staff working in the drill floor area, as well as damage to equipment and machines.

SUMMARY

An aspect of the present invention is to provide improved techniques and solutions to improve the functionality and reliability of fingerboards and similar storage arrangements, and to provide other advantages compared to known solutions.

In an embodiment, the present invention provides a fingerboard latch arrangement which includes an elongate support member, a latch configured to move from a closed position into an open position and from the open position into the closed position, and an activation member which is connected to and which is movable longitudinally along the elongate support member. The activation member comprises means configured to bring the latch from the closed position into the open position and from the open position into the closed position.

BRIEF DESCRIPTION OF THE DRAWINGS

The present invention is described in greater detail below on the basis of embodiments and of the drawings in which.

DETAILED DESCRIPTION

The present invention relates to storage of drill pipes, casing, bottom hole assemblies, risers, or any elongate tool that is needed on an offshore drilling or well intervention vessel or in any kind of subsea operation using tubular shaped tools. Other examples for which the present invention may be suitable for use include research vessels, geothermal drilling, deep sea mining etc.

In an embodiment, the present invention provides a fingerboard latch arrangement having an elongate support member, a latch having a closed position and an open position, an activation member connected to and movable longitudinally along the elongate support member, the activation member comprising means for bringing the latch from the closed position to the open position, and from the open position to the closed position.

In an embodiment, the present invention provides a fingerboard latch arrangement comprising a latch having an actuation element, the latch rotatably connected to a support member whereby the latch is rotatable about an axis of rotation between a closed position and an open position, and an actuation member having an actuation surface extending between first and second sides of the actuation member, the actuation surface and the actuation element being configured for movable engagement, wherein the actuation member is arranged to move relative to the latch in order to movably engage the actuation surface and the actuation element.

In an embodiment, the present invention provides a fingerboard having a plurality of fingers arranged in a fingerboard plane, each finger having a plurality of latches arranged thereon, each latch rotatable about an axis of rotation between a closed position and an open position, an actuation member movable in the fingerboard plane or parallel with the fingerboard plane and configured to successively engage and rotate at least two of the plurality of latches about the axis of rotation, wherein the axis of rotation is parallel to the fingerboard plane.

Embodiments of the present invention are described in greater detail below based on the drawings.

Figure 1:
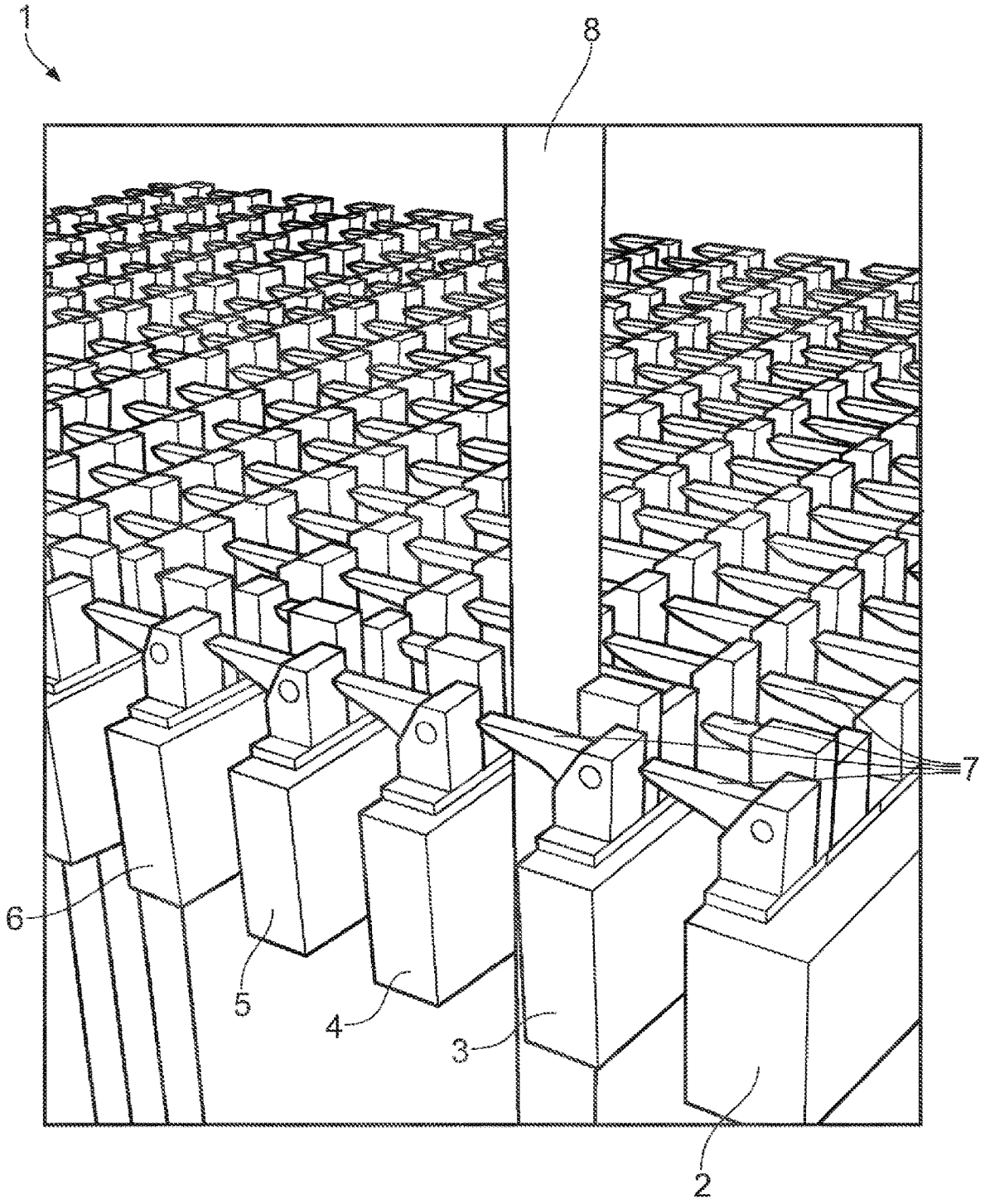
Fig. 1 (Prior Art)
FIG. 1 shows a fingerboard according to the prior art.

FIG. 1 shows a typical fingerboard 1 which is used, for example, on drilling rigs. The fingerboard 1 has a plurality of fingers 2-6, i.e., parallel elongate support members defining storage spaces between them, in which sections of drill pipe 8 or other tubular members may be stored. The plurality of fingers 2-6 are arranged in a horizontal plane defined by the fingers 2-6. The fingerboard 1 further comprises a large number of latches 7, each latch 7 being fixed to a finger 2-6 so as to define a large number of storage slots defined by the fingers 2-6 and the latches 7. The latches 7 are conventionally actuated pneumatically so that a given latch can be opened when a tubular is being removed from the fingerboard 1 by a pipe handling machine (not shown) or when a tubular is placed in the fingerboard 1 for storage.

FIGS. 2-8 show a fingerboard latch arrangement 100 according to an embodiment of the present invention. The fingerboard latch arrangement 100 has an elongate support member 10; the elongate support member 10 may be integral with a finger in a fingerboard, or it may, for example, be a beam which can be attached to a finger, thereby allowing the retrofitting the fingerboard latch arrangement 100 on existing fingerboards.

Figure 2:
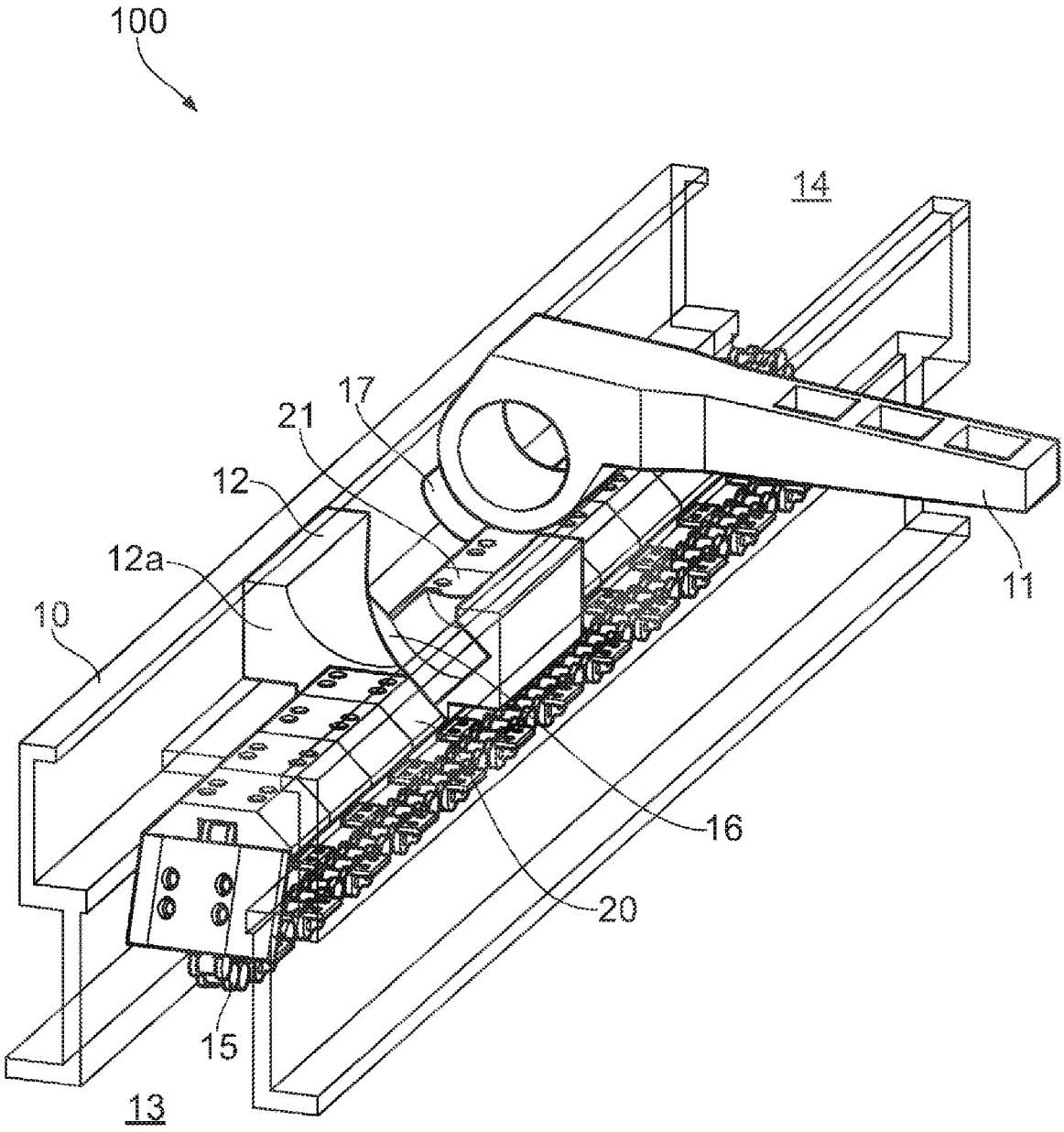
FIG. 2 shows a fingerboard latch arrangement according to an embodiment of the present invention.
Figure 3:
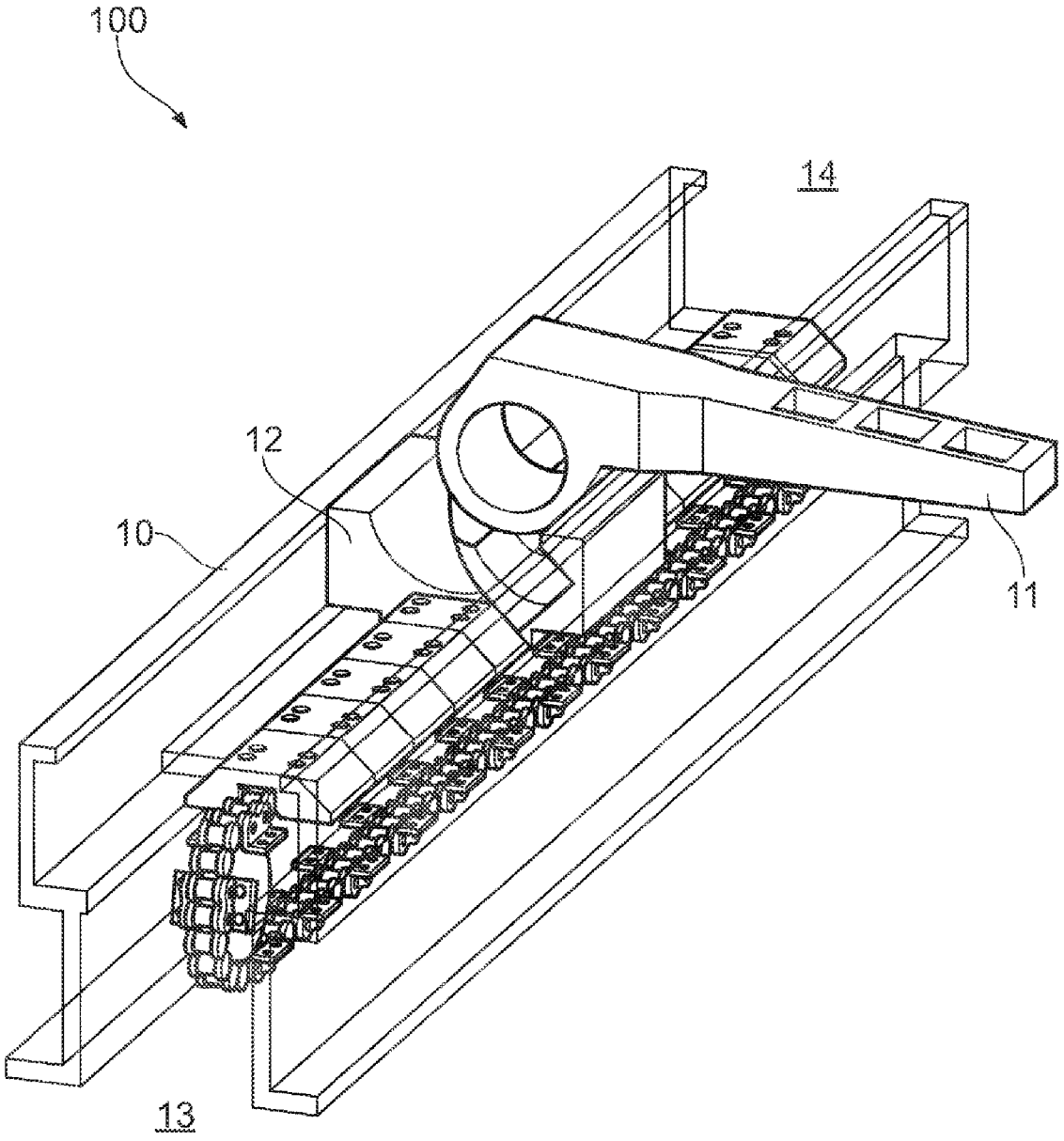
FIG. 3 shows a fingerboard latch arrangement according to an embodiment of the present invention.
Figure 4:
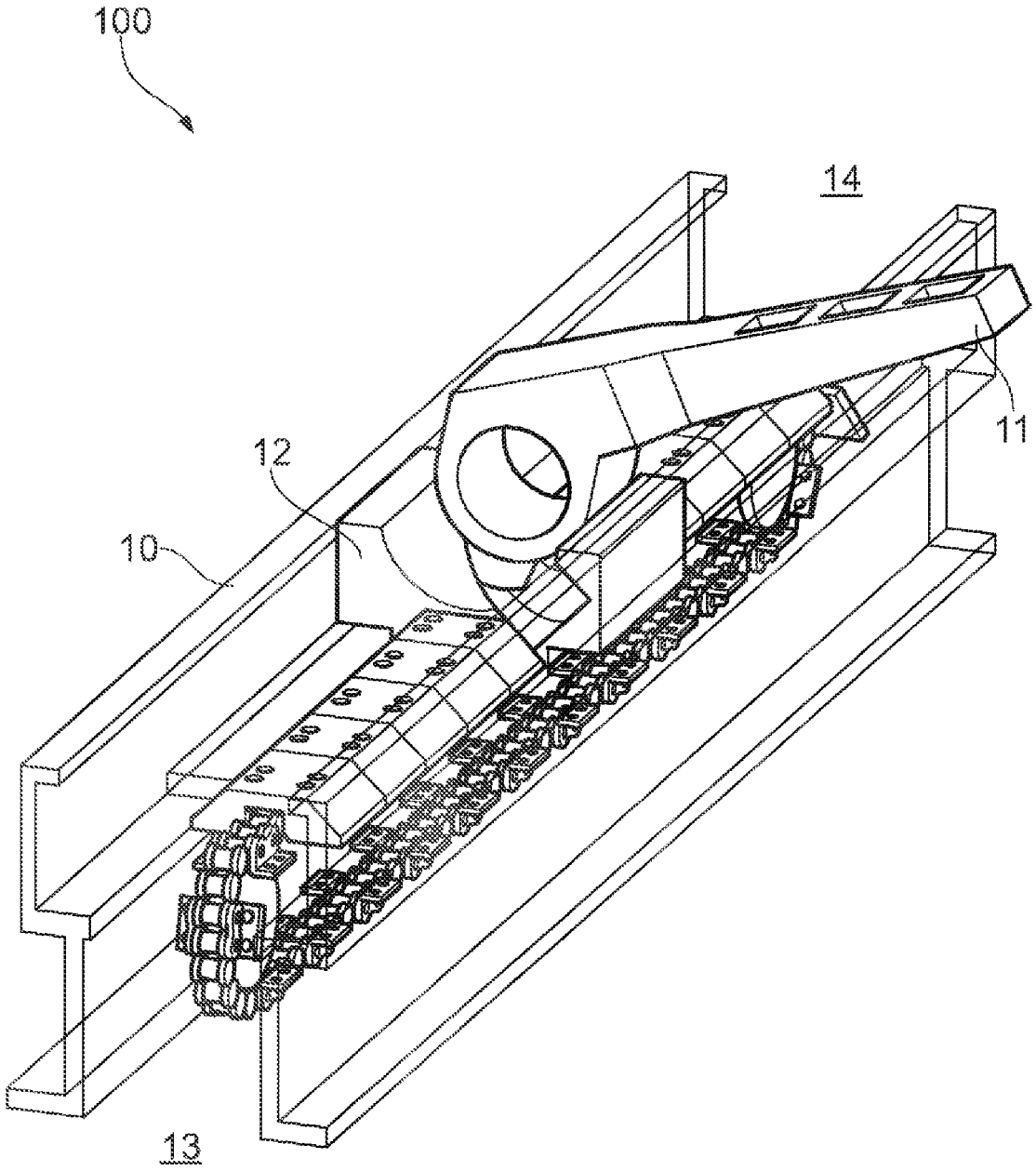
FIG. 4 shows a fingerboard latch arrangement according to an embodiment of the present invention.
Figure 5:
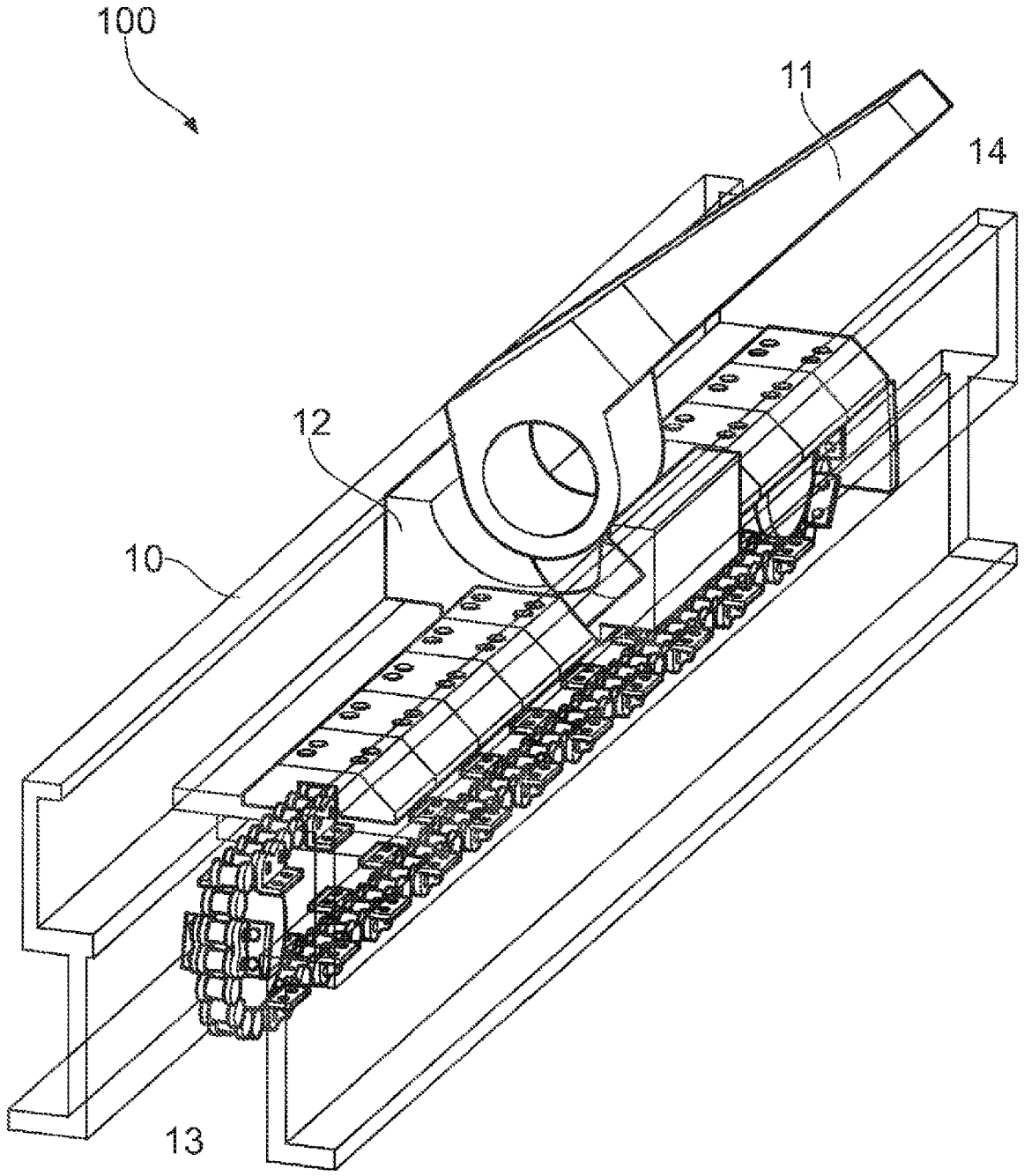
FIG. 5 shows a fingerboard latch arrangement according to an embodiment of the present invention.
Figure 6:
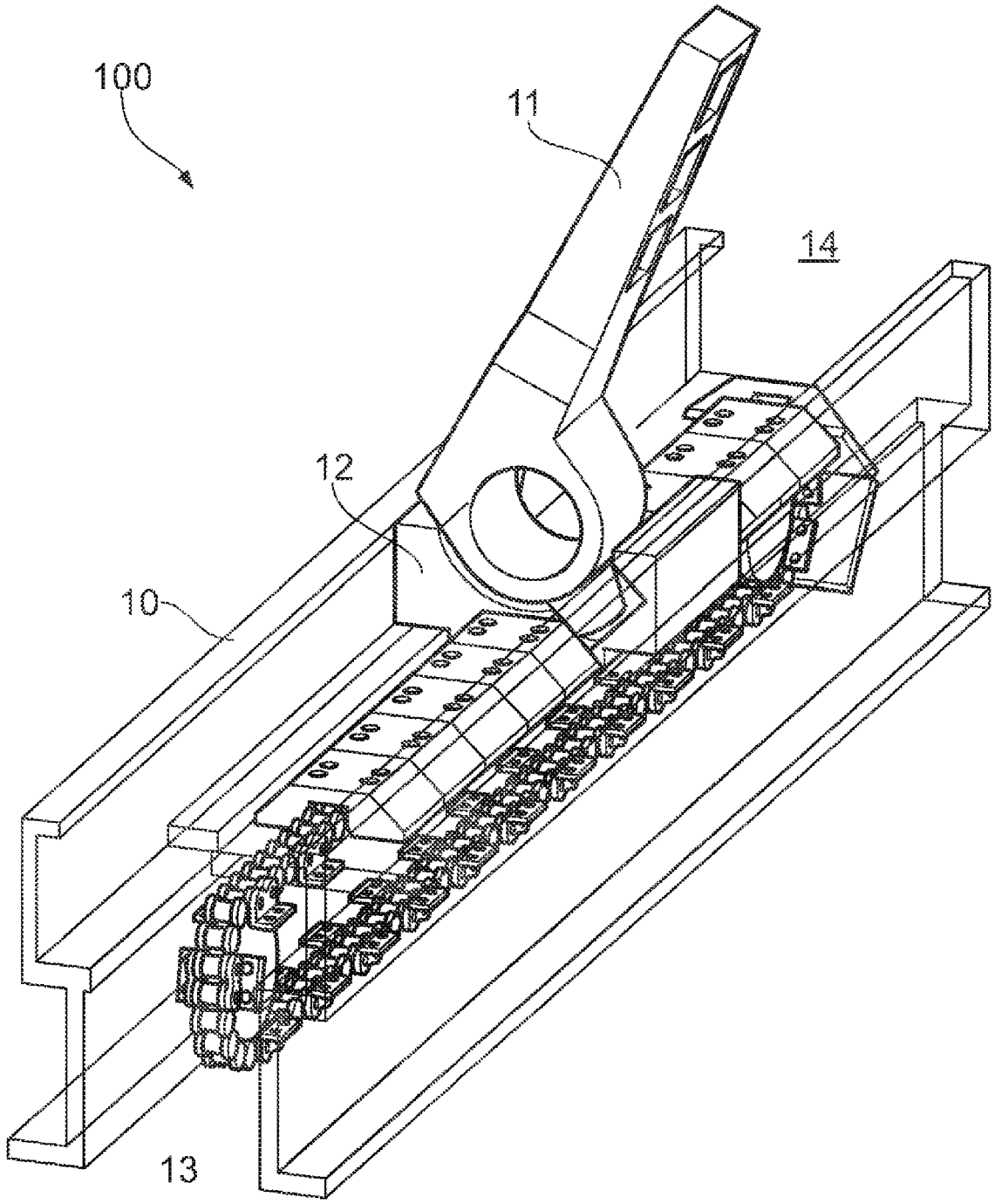
FIG. 6 shows a fingerboard latch arrangement according to an embodiment of the present invention.
Figure 7:
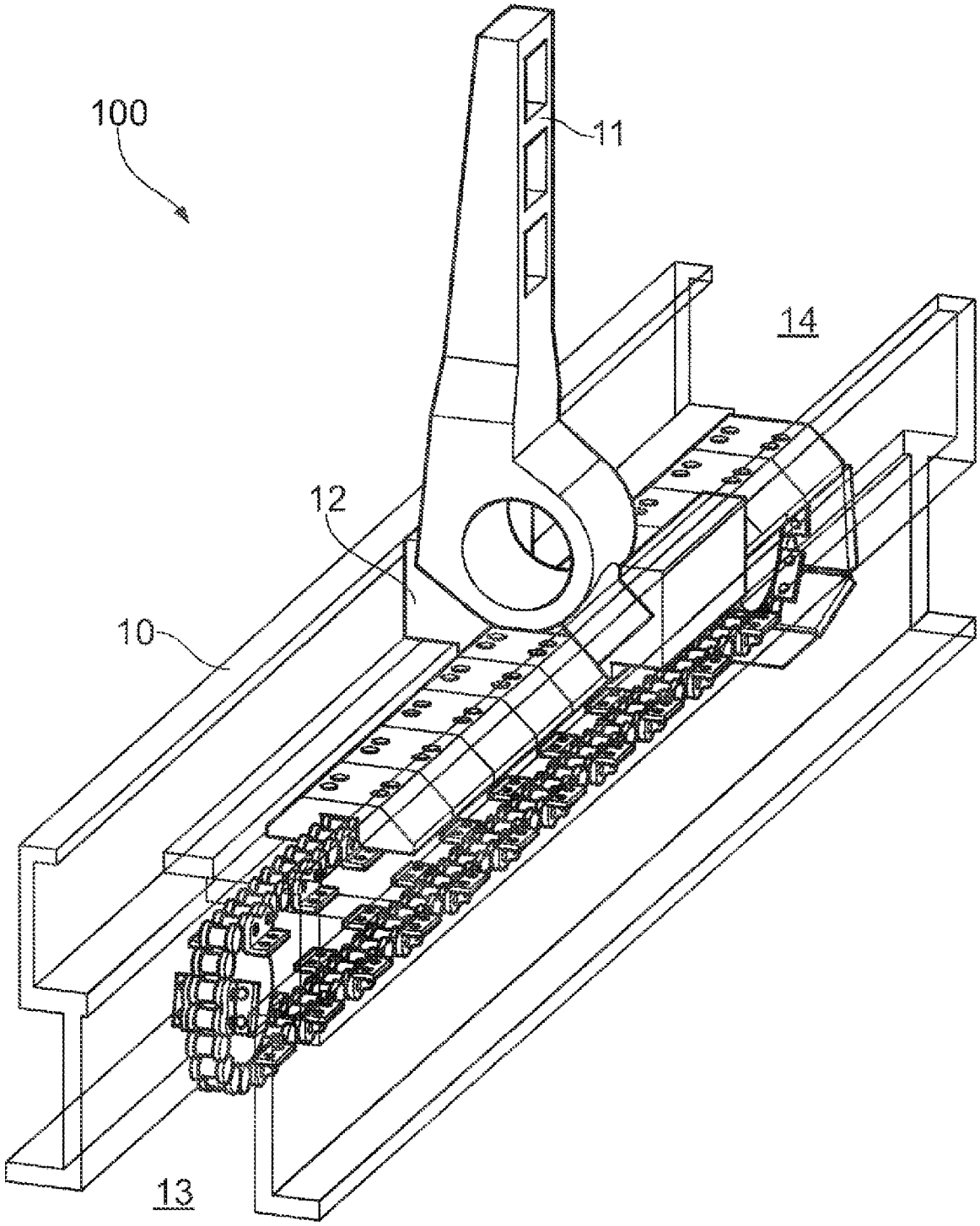
FIG. 7 shows a fingerboard latch arrangement according to an embodiment of the present invention.
Figure 8:
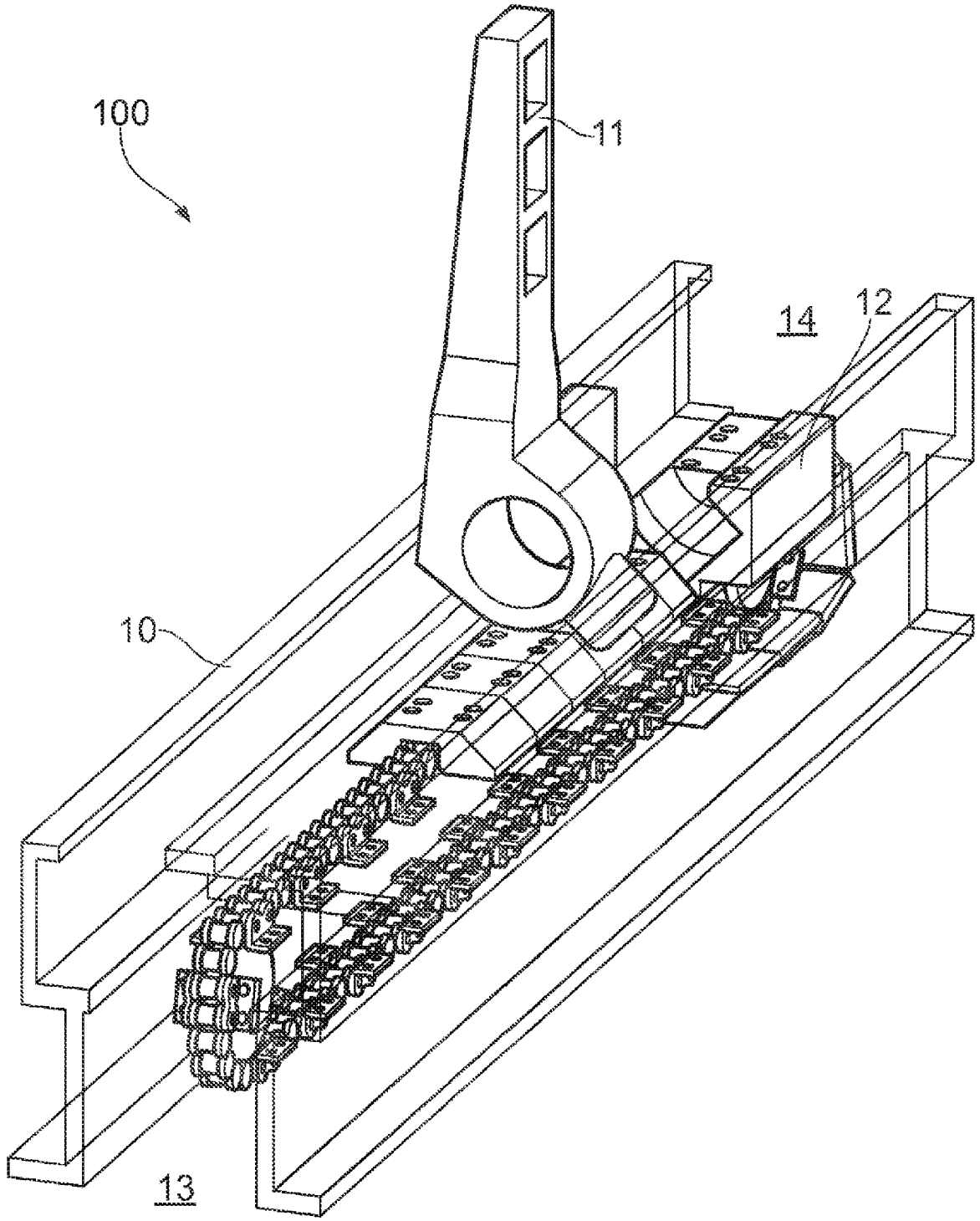
FIG. 8 shows a fingerboard latch arrangement according to an embodiment of the present invention.
Figure 11:
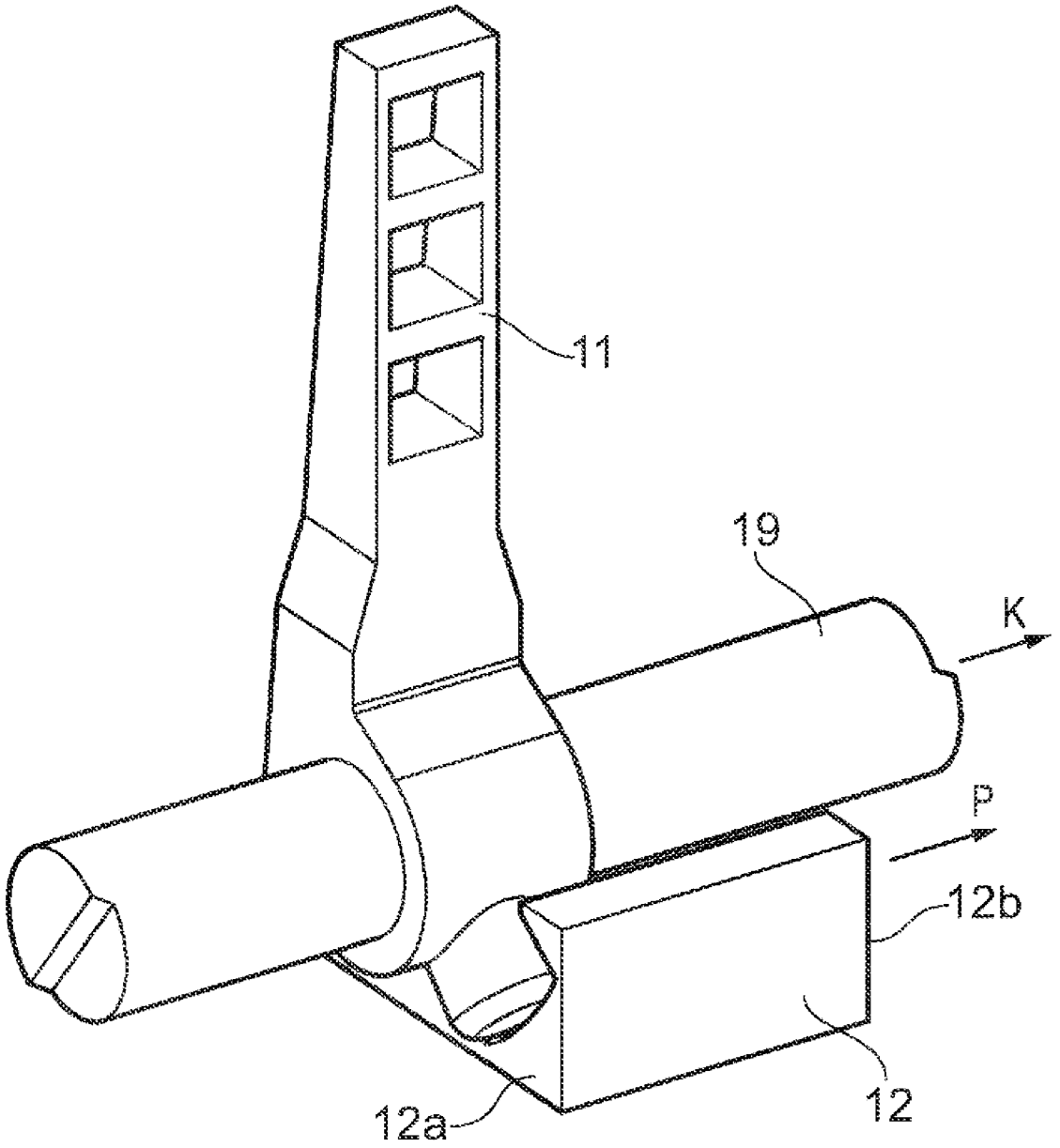
FIG. 11 shows a pivot for the latch of the latch arrangement of the present invention.

A latch 11 is arranged on the elongate support member 10 via a pivot 19, which is not shown in FIGS. 2-8 for reasons of clarity, but which is shown in FIG. 11. The pivot 19 is fixed to the elongate support member 10, and the latch 11 is supported sideways but may rotate around the pivot 19 around an axis of rotation K. In the illustrated embodiment, the axis of rotation K is parallel with the elongate support member 10. The latch 11 has a closed position, as shown in FIG. 2, and an open position, as shown in FIGS. 7 and 8. An activation member 12 is connected to, and movable longitudinally along, the elongate support member 10, the activation member 12 comprising means for moving the latch 11 from the closed position to the open position, and from the open position to the closed position.

The means are configured to engage the latch 11 upon movement of the activation member 12 from one side 13 (i.e., the first side 13) of the latch 11 to the other side 14 (i.e., the second side 14) of the latch 11, i.e., as the activation member 12 is moved past the latch 11 along the elongate support member 10. When the activation member 12 is moved from the first side 13 of the latch 11 to the second side 14 of the latch 11, the means engage the latch 11 and bring the latch 11 from the closed position to the open position. This sequence is illustrated in FIGS. 2-8. Conversely, when the activation member 12 is moved from the second side 14 of the latch 11 to the first side 13 of the latch 11, the means engage the latch 11 and bring the latch 11 from the open position to the closed position. This process follows the same sequence as shown in FIGS. 2-8, but in reverse.

In the embodiment shown, the means are an activation surface 16 configured to engage an activation element 17, for example, a pin arranged on the latch 11 which moves the latch 11 from an open to a closed position or from an open position to a closed position. Upon movement of the activation member 12 from the first side 13 of the latch 11 to the second side 14 of the latch, the activation surface 16 thus provides a force on the activation element 17 so as to rotate the latch 11 from the closed position to the open position, and upon movement of the activation member 12 from the second side 14 of the latch 11 to the first side 13 of the latch 11, the activation surface 16 provides a force on the activation element 17 so as to move the latch 11 from the closed position to the open position.

Figure 9:
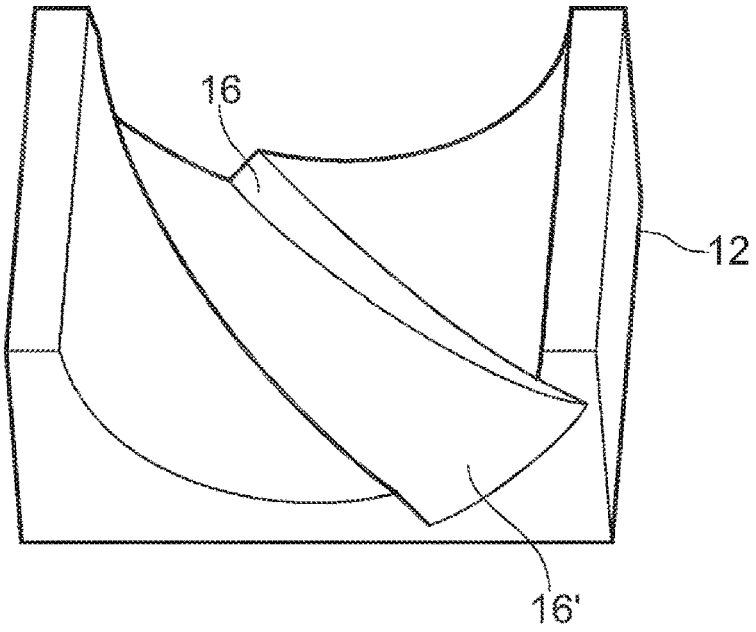
FIG. 9 shows an activation surface of an activation member of the present invention.
Figure 10:
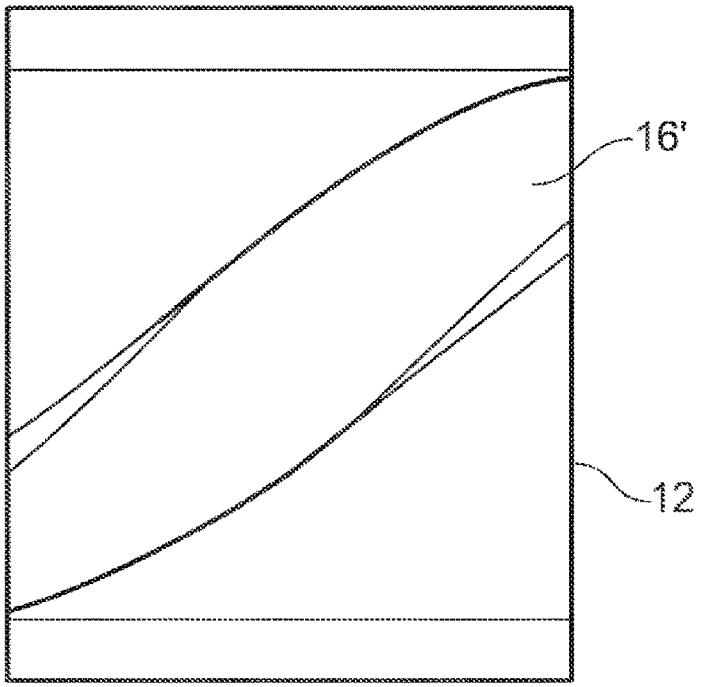
FIG. 10 shows an activation surface of an activation member of the present invention.

As illustrated in greater detail in FIGS. 9 and 10, the activation surface 16 may be part of a curved and/or angled recess 16' on the activation member 12. The activation element 17, in this case a pin arranged on the latch 11, will enter the recess 16' and be driven to rotate the latch 11 to the desired position.

The activation member 12 is arranged on a conveyor element 15, where the conveyor element 15 is movable longitudinally along the elongate support member 10, as shown sequentially in FIGS. 2-8. The conveyor element 15 can be an endless band connected to the elongate support member 10, as illustrated, or, alternatively, a linearly moving element.

Figure 12:
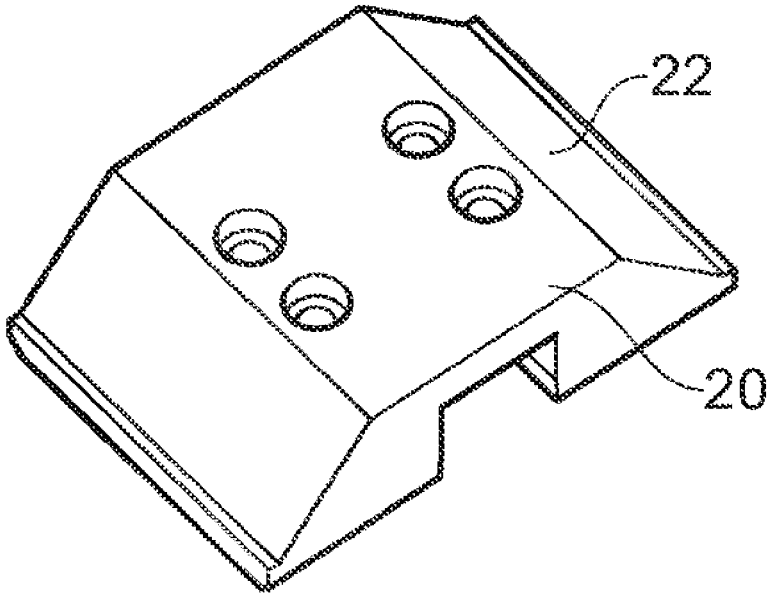
FIG. 12 shows a first locking member of the fingerboard latch of the present invention.

The fingerboard latch arrangement 100 further comprises a first locking member 20 (see also FIG. 12) connected to, and movable longitudinally along, the elongate support member 10. The first locking member 20 is arranged on a first side 12*a* (see also FIG. 11) of the activation member 12 and fixed to the activation member 12 so that the first locking member 20 moves along with the activation member 12. The first locking member 20 is configured to hold the latch 11 in the open position when the activation member 12 is on the second side 14 of the latch 11. This is performed by means of a first locking surface 22 (see FIG. 12) which is configured to engage the activation element (pin) 17 and thereby provide that the latch 11 cannot return to the closed position when the activation member 12 is on the second side 14 of the latch 11.

Figure 13:
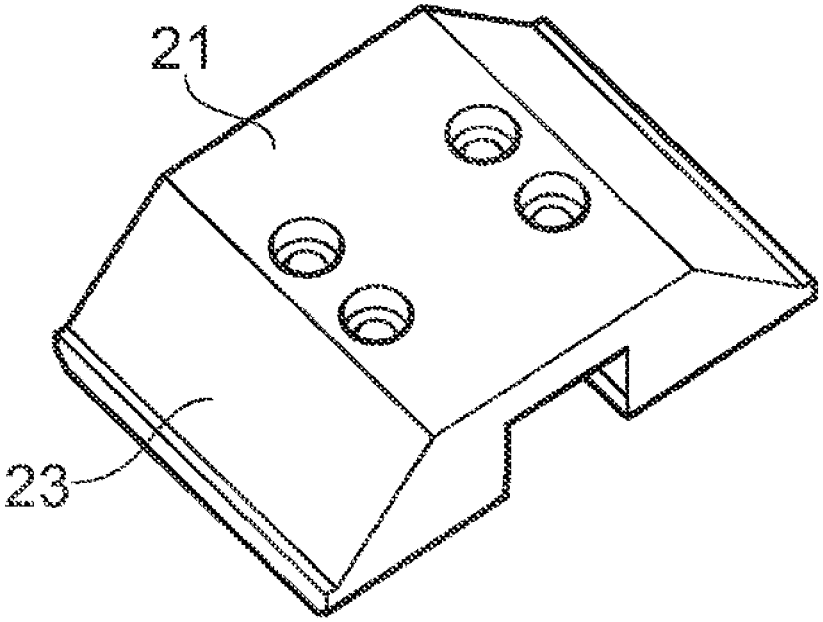
FIG. 13 shows a second locking member of the fingerboard latch of the present invention.

The fingerboard latch arrangement 100 further has a second locking member 21 (see also FIG. 13) connected to, and movable longitudinally along, the elongate support member 10. The second locking member 21 is arranged on a second side 12*b* (see FIG. 11) of the activation member 12 and fixed to the activation member 12. The second locking member 21 is configured to hold the latch 11 in the closed position in the same manner as described above, i.e., by means of a second locking surface 23 (see FIG. 13) configured to engage the activation element (pin) 17 and thereby provides that the latch 11 cannot return to the open position when the activation member 12 is on the first side 13 of the latch 11.

The first locking member 20 and the second locking member 21 may be arranged on the conveyor element 15. The first locking member 20 and/or the second locking member 21 may comprise a plurality of individual locking member elements arranged on the conveyor element 15.

The elongate support member 10 may have a plurality of latches having a design similar to the latch 11 shown here, and spaced longitudinally along the elongate support member 10 in a similar manner as shown in FIG. 1. The activation member 12 may thereby operate several, or all, latches on one finger in a fingerboard.

Figure 14:
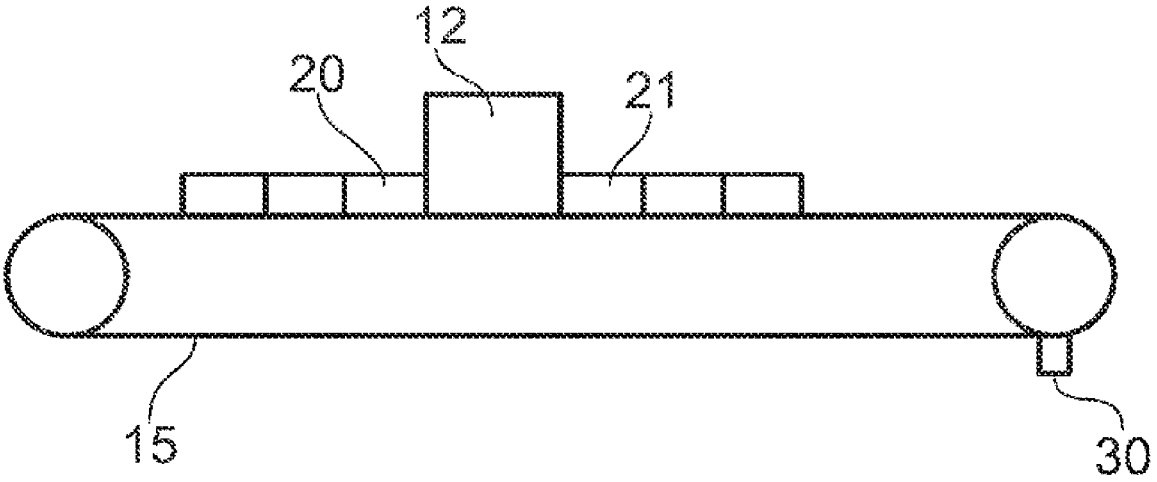
FIG. 14 shows the first locking member and the second locking member arranged on a conveyor element.

FIG. 14 schematically illustrates an embodiment further comprising a sensor 30, the sensor 30 being configured to measure a parameter indicative of the position of the activation member 12. In the illustrated embodiment, the sensor 30 is arranged in relation to the conveyor element 15 so as to measure a parameter relating to the state of the conveyor element 15. The position of the activation member 12 can thereby be deduced based on this measurement. The state of the conveyor element 15 may, for example, be it's linear position, a rotational position of a motor driving the conveyor element 15 (in the case of a band, as illustrated), or any other parameter permitting the position of the activation member 12 to be found. The sensor 30 may alternatively be a position sensor measuring the position of the activation member 12, or that of, for example, a locking member 20, 21, directly.

The fingerboard latch arrangement 100 according to embodiments of the present invention allow a more secure and reliable operation of a fingerboard to be achieved. A more secure actuation of the latch is achieved, for example, by using an activation member 12 which brings the latch 11 from the open position to the closed position or from the closed position to the open position when the activation member 12 is moved longitudinally along the elongate support member 10. If a plurality of latches exist on a finger in a fingerboard, the activation member 12 may operate all the latches, and a more secure and reliable system can be achieved, compared to, for example, latches being individually, pneumatically actuated. Locking members 20, 21 provide that the latch 11 stays in the desired position. In a fingerboard system, one can, for example, provide that when collecting a pipe section from a deep slot in a fingerboard, none of the high number of latches in front of the deep slot is erroneously in the closed position due, for example, to failure of an individual pneumatic actuator. An improved control of the fingerboard state can also be achieved, for example, via the sensor 30, in that the position of the activation member 12 will be indicative of the state of all latches for one finger, and one is not reliant on individual sensors for each latch.

The present invention is not limited to embodiments described herein; reference should be had to the appended claims.

What is claimed is:

1. A fingerboard latch arrangement comprising:

an elongate support member;

a latch configured to move from a closed position into an open position and from the open position into the closed position; and an activation member which is connected to and which is movable longitudinally along the elongate support member, the activation member comprising means configured to bring the latch from the closed position into the open position and from the open position into the closed position, wherein, the fingerboard latch arrangement is configured to store at least one elongate item, the elongate item being a drill pipe, a casing, a bottom hole assembly, a riser, a tubular member, an elongate or a tubular shaped tool or equipment, the elongate item being configured for use in a drilling operation, in offshore drilling, on a well intervention vessel, in subsea mining, or in a subsea operation.

2. The fingerboard latch arrangement as recited in claim 1, further comprising:

a conveyor element which is configured to be movable longitudinally along the elongate support member, wherein, the activation member is arranged on the conveyor element.

3. The fingerboard latch arrangement as recited in claim 1, further comprising:

a first locking member which is connected to and which is movable longitudinally along the elongate support member, the first locking member being configured to hold the latch in the open position or in the closed position.

4. The fingerboard latch arrangement as recited in claim 3, further comprising:

a second locking member which is connected to and which is movable longitudinally along the elongate support member, wherein, the first locking member is configured to hold the latch in the open position, and the second locking member is configured to hold the latch in the closed position.

5. The fingerboard latch arrangement as recited in claim 4, wherein, the latch comprises an activation element arranged thereon, the first locking member comprises a first locking surface which is configured to engage the latch and to hold the latch in the open position, the second locking member comprises a second locking surface which is configured to engage the latch and to hold the latch in the closed position, and at least one of the first locking surface and the second locking surface are further configured to engage the activation element on the latch.

6. The fingerboard latch arrangement as recited in claim 1, where the activation member is configured to rotate the latch.

7. A fingerboard latch arrangement comprising:

a support member;

a latch comprising an actuation element, the latch being rotatably connected to the support member so as to rotate about an axis of rotation between a closed position and an open position; and an actuation member comprising a first side, a second side, and an actuation surface which extends between the first side and the second side, the actuation surface and the actuation element being configured for a movable engagement, the actuation member being configured to move relative to the latch so as to movably engage the actuation surface and the actuation element, wherein, the fingerboard latch arrangement is configured to store at least one elongate item, the elongate item being a drill pipe, a casing, a bottom hole assembly, a riser, a tubular member, an elongate or a tubular shaped tool or equipment, the elongate item being configured for use in a drilling operation, in offshore drilling, on a well intervention vessel, in subsea mining, or in a subsea operation.

8. The fingerboard latch arrangement as recited in claim 7, further comprising:

locking members arranged on either side of the actuation member.

9. The fingerboard latch arrangement as recited in claim 8, wherein each of the locking members comprises a locking surface which is arranged adjacent the actuation surface.

10. The fingerboard latch arrangement as recited in claim 7, wherein the actuation surface comprises a helical groove.

11. The fingerboard latch arrangement as recited in claim 7, further comprising:

a fingerboard finger, wherein, the support member is connected to or integrated in the fingerboard finger.

12. The fingerboard latch arrangement as recited in claim 7, wherein the actuation member is further configured to move along a path which is parallel with the axis of rotation.

13. A fingerboard comprising:

a plurality of fingers arranged in a fingerboard plane, each of the plurality of fingers comprising a plurality of latches arranged thereon, each of the plurality of latches being configured to rotate about an axis of rotation between a closed position and an open position; and an actuation member configured to be movable in the fingerboard plane or parallel with the fingerboard plane and to successively engage and rotate at least two of the plurality of latches about the axis of rotation, wherein, the axis of rotation is parallel to the fingerboard plane.

14. The fingerboard as recited in claim 13, wherein, the at least two of the plurality of latches each comprise an actuation element arranged thereon, and the actuation member comprises an actuation surface which is configured to movably engage the actuation element on the at least two of the plurality of latches.

15. The fingerboard as recited in claim 14, wherein, the actuation member comprises a first side and a second side, and the actuation surface is configured to extend between the first side and the second side of the actuation member.

16. The fingerboard as recited in claim 14, wherein the actuation surface comprises a helical groove.

17. The fingerboard as recited in claim 13, further comprising:

locking members which are arranged to the actuation member.

18. The fingerboard as recited in claim 17, wherein each of the locking members comprises a locking surface.

19. The fingerboard as recited in claim 13, wherein the actuation member is movably connected to one of the plurality of fingers.

20. The fingerboard as recited in claim 13, wherein the actuation member is arranged to move along a path which is parallel with the axis of rotation.

* * * * *